US005638713A

United States Patent [19]

Roth et al.

[11] Patent Number: 5,638,713

[45] Date of Patent: Jun. 17, 1997

[54] UNIVERSAL BACKUP HANDCUFF KEY

[75] Inventors: Robert A. Roth, Sarasota, Fla.; Karmen Lee Wheelbarger, Dayton, Va.

[73] Assignee: Advanced Technologies Group, Jacksonville, Fla.

[21] Appl. No.: 629,757

[22] Filed: Apr. 9, 1996

[51] Int. Cl.[6] ..... A47G 29/10

[52] U.S. Cl. ..... 70/404; 70/408; 70/457; 70/458; 206/37.1; 206/38.1

[58] Field of Search ..... 70/456 R, 457, 70/458, 460, 403, 404, 408, 396, 399, 407; 206/37.1, 37.3, 37.4, 37.5, 37.6, 37.7, 37.8, 38.1; D3/207, 212; 24/3.6

[56] References Cited

U.S. PATENT DOCUMENTS

| | | | |
|---|---|---|---|
| Re. 32,914 | 5/1989 | Almblad | 70/458 |
| 47,325 | 4/1865 | Oaks | 70/403 |
| 561,941 | 6/1896 | Josler | 70/408 |
| 1,517,177 | 11/1924 | Stone | 70/404 |
| 2,457,195 | 12/1948 | Bagnall, Jr. | 70/457 |
| 3,981,169 | 9/1976 | Youd | 70/456 R |
| 4,314,467 | 2/1982 | Arvan | 70/456 R |
| 4,348,881 | 9/1982 | Toyoda | 70/456 R |
| 4,677,835 | 7/1987 | Almblad | 70/457 X |
| 4,778,302 | 10/1988 | Martinez | 70/456 R X |
| 4,901,547 | 2/1990 | Dal Palú | 70/457 X |
| 4,941,335 | 7/1990 | Allen | 70/458 |
| 4,944,171 | 7/1990 | Oliana | 70/458 X |
| 4,959,983 | 10/1990 | Hsu | 70/408 X |
| 5,022,247 | 6/1991 | Beck | 70/458 X |
| 5,046,343 | 9/1991 | Miwa | 70/408 |
| 5,460,022 | 10/1995 | Parsons | 70/456 R |
| 5,501,090 | 3/1996 | Mattiuzzo | 70/457 X |
| 5,544,510 | 8/1996 | Botteon et al. | 70/456 R |

FOREIGN PATENT DOCUMENTS

| | | | |
|---|---|---|---|
| 376276 | 8/1907 | France | 70/408 |
| 17233 | of 1888 | United Kingdom | 70/408 |

*Primary Examiner*—Lloyd A. Gall
*Attorney, Agent, or Firm*—H. Jay Spiegel

[57] ABSTRACT

A round and flat molded device not readily identifiable as a handcuff key, which can be hidden under a wrist watch or behind a standard shirt button of a law enforcement officer or security person and which can be silently retrieved and utilized by bending the key portion partially out of the surrounding molded support ring structure with the use of the thumb, index finger and middle finger.

9 Claims, 4 Drawing Sheets

UNIVERSAL BACKUP HANDCUFF KEY

BACKGROUND OF THE INVENTION

The present invention relates to keys for restraining devices such as handcuffs used by law enforcement or security personnel. In general, manufacturers of handcuffs include a standard "L" shaped metal handcuff key with each new set of handcuffs. A standard handcuff key is universal in the way it works and can have a longer or shorter locking pin, a longer or shorter shank with a deeper or shallower barrel, but are usually configured to be carried on a key chain. When carried on a typical key chain in the pocket, the sharp edges of the tumbler and pin can snag clothing and gouge the body. Furthermore, such a key is also visible and readily identifiable as a handcuff key.

U.S. Pat. No. 5,460,022 to Parsons discloses a handcuff key disguised as a diverse item such as a pen holder, a knife holder or a rectangular case. The Parsons device is not easily accessible nor does the Parsons device provide concealability for a standard handcuff key. Applicants are unaware of any other concealable handcuff key nor any key including the specific configuration, structure and use of the present invention.

SUMMARY OF THE INVENTION

The present invention relates to a universal backup handcuff key. The concept of the subject invention consists of a unique universal handcuff key made for easy concealment but which can be readily accessible during normal or emergency use. The small circular and flat construction allows it to be hidden under a wrist watch or behind a standard shirt button. The overall size and configuration is critical to the effectiveness of this inventive universal handcuff key. When the subject invention is used as intended, law enforcement or security personnel cannot be restrained with their own handcuffs, whether behind their back or around an object, since the subject invention is intended to be stored and hidden in an accessible manner.

The present invention is preferably manufactured by injection molding out of a thermoplastic polymer material. Due to the specific configuration of the present invention, it can be hidden under a standard wrist watch or can alternatively be worn behind a standard shirt button such as those employed by law enforcement officers or security personnel and can be used for emergency back-up purposes due to the concealed nature thereof. A piece of double sided tape may be employed to permit affixing the inventive key more securely to the back side of a standard wrist watch.

SPECIFIC DESCRIPTION OF THE PREFERRED EMBODIMENT

Figure 1:
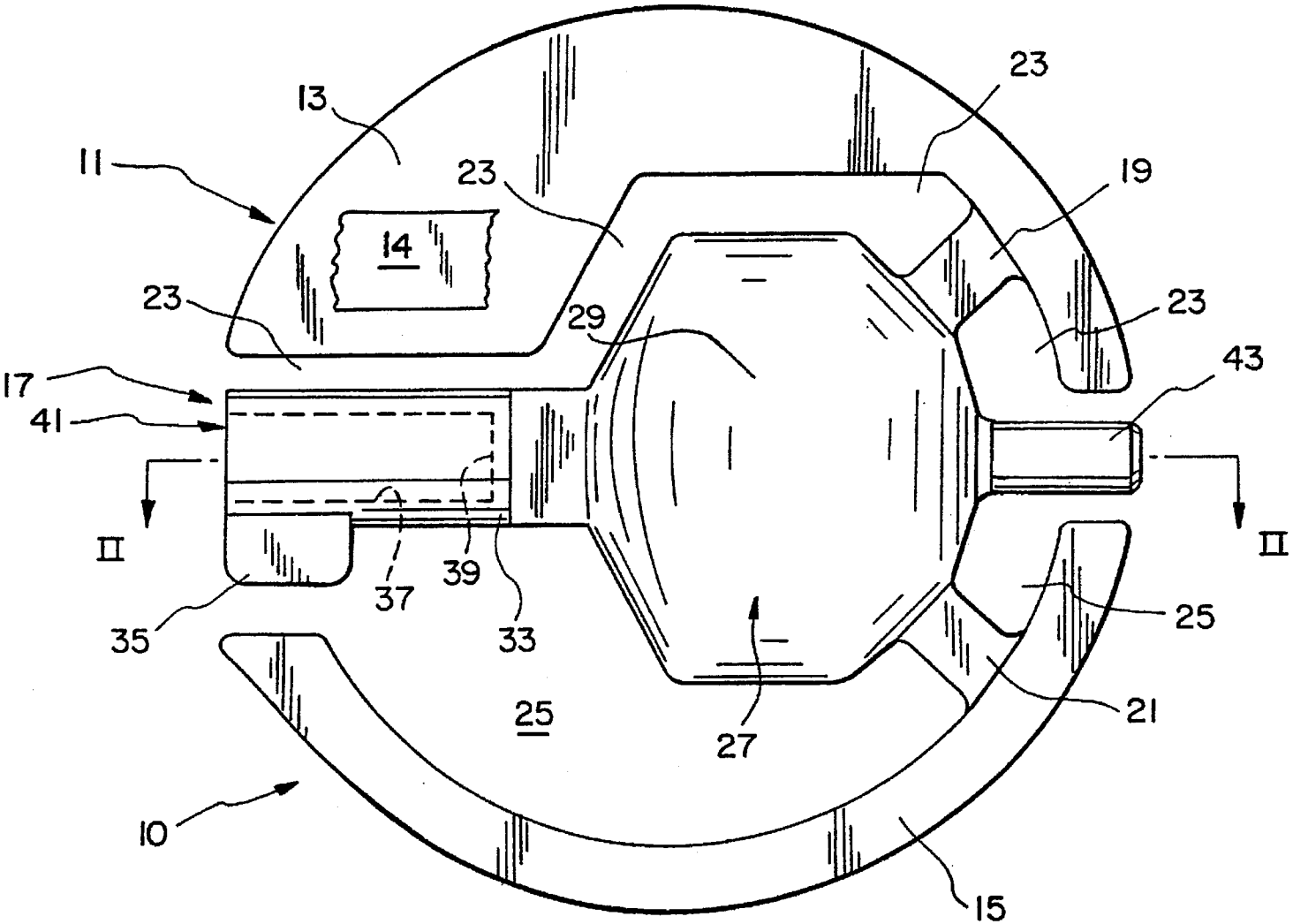
FIG. 1 shows a top view of the present invention.
Figure 2:
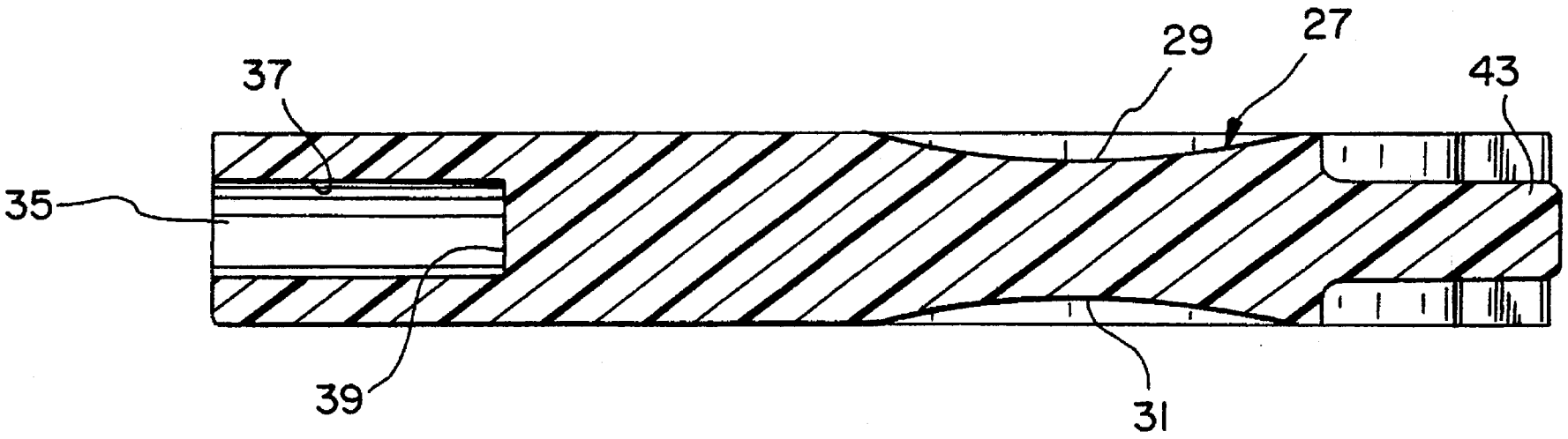
FIG. 2 shows a cross-sectional view along the line II—II of FIG. 1.

With reference, first, to FIG. 1, the present invention is generally designated by the reference numeral 10 and is seen to include a generally flat circular body 11 which, with reference to FIG. 2, is seen to be extremely thin in configuration.

Figure 3:
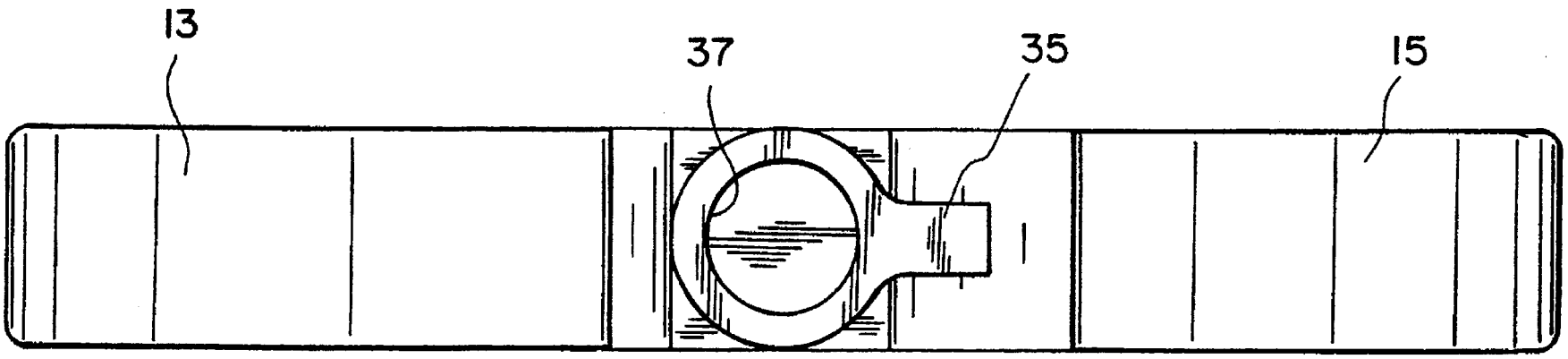
FIG. 3 shows a side view of the present invention.
Figure 4:
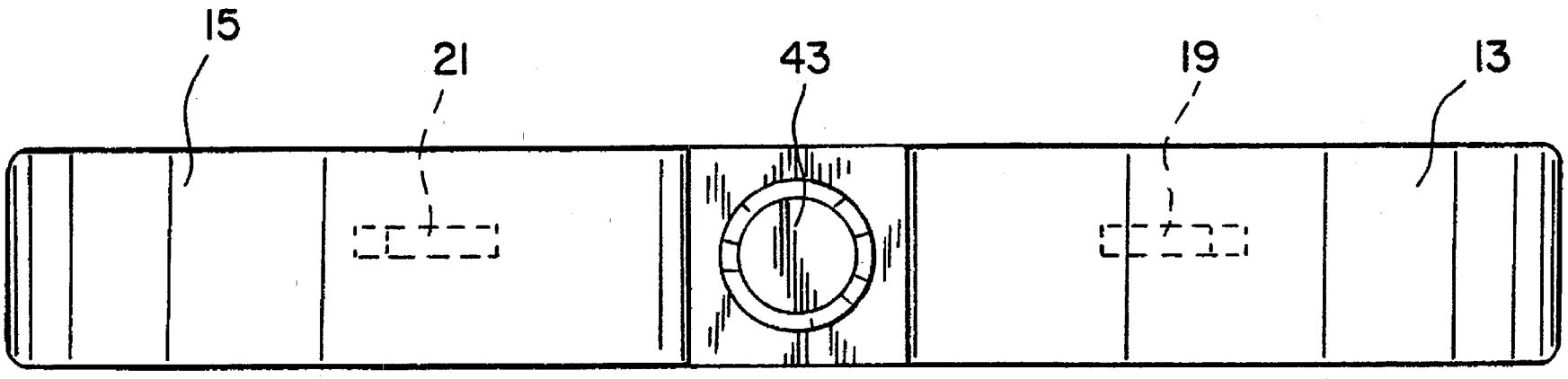
FIG. 4 shows a view from the other side of the present invention.

The body 11 includes portions 13 and 15 interconnected with a key portion 17 by support hinges 19 and 21. The portions 13 and 15 together comprise a flat support portion generally coplanar with and equal in thickness to the key portion 17 (FIGS. 2, 3 and 4). The hinges 19 and 21 have a thickness less than the thickness of the portions 13, 15 and the key portion 17 as seen in FIG. 4.

As best seen in FIG. 1, the portion 13 and the key portion 17 define, therebetween, an open space 23. The portion 15 and the key portion 17 define, therebetween, an open space 25.

The key portion 17 includes a gripping portion 27 which, as best seen in FIG. 2, includes two opposed indented surfaces 29 and 31. Emanating from the gripping portion 27 in the left-hand direction in the view of FIG. 1 is the key barrel 33 having, depending therefrom, the tumbler 35. The barrel includes a generally cylindrical recess or blind bore 37 having a closed wall 39 and an opening 41. The blind bore 37 is shown in phantom in FIG. 1 and is better seen in the cross-sectional view of FIG. 2.

Extending in the right-hand direction in the view of FIG. 1 from the gripping portion 27 is a locking pin 43 that is employed, as is customary, to initiate the "cuff lock" function of a typical pair of handcuffs so that the handcuffs cannot be closed further once placed on a detainee. The generally cylindrical nature of the locking pin 43 is best seen in FIGS. 2 and 4. The cylindrical nature of the recess 37 is best seen from FIGS. 2 and 3. As seen in FIG. 1, a piece of double-sided adhesive tape 14 may be affixed, for example, on the support portion 13 to enhance fixation of the key 10 where desired.

In either an emergency situation when the law enforcement officer or security person has been handcuffed or during regular detainee use, the present invention is easily and silently removed from under the wrist watch by pushing it out or alternatively removing it from behind a standard shirt button. Once removed from the concealed location, the key portion 17 is bent out by way of two flexible support hinges 19, 21 attached to the surrounding support portions 13 and 15, respectively, to a skewed position between 45 and 90 degrees from the plane of the support portions by applying opposing and concurrent pressures against both the key portion 17 and the support portions 13 and 15 with the thumb against the key and both the index finger and the middle finger of the same hand on the opposite side of the support portions. The support portions, as best seen in FIG. 1, combine together to form a support ring made up of first and second arcuate ring portions 13 and 15.

The key portion 17 is then grasped by the thumb and index finger on the concave surfaces 29, 31 of the gripping portion 27, and the key barrel 33 and tumbler 35 are inserted into the handcuffs. All manipulations, i.e., removal, bending out of the key and insertion into the handcuffs, can be done easily with one hand.

The small optional locking pin 43 located at the rear of the present invention is used to initiate the "cuff lock" function of the handcuffs so that the handcuffs cannot be closed further once placed on a detainee.

The present invention is preferably manufactured from plastic resin for lightweight, maximum stiffness and strength to weight ratio, resistance to corrosion and non-metallic, non-magnetic properties. More specifically, it is preferred that the present invention be molded of a thermoplastic resin such as polypropylene, nylon, polyester, polycarbonate, polyacetal and/or ABS (acrylonitrile-butadiene-styrene), having a balance of desirable physical, mechanical and molding properties. Among the many kinds of thermoplastics, Type 66 nylon and thermoplastic polyester, both reinforced with 10 to 50 percent by weight glass fiber, have been found to provide an optimum balance of properties including stiffness and flexural strength in the key barrel and tumbler with flexibility in the hinges and critical dimensional stability and surface smoothness for ease of insertion into and opening of the handcuff lock. Although specific plastic materials of construction have been suggested above, their enumeration is not intended to be all inclusive, nor limiting in the scope of the present invention. The scope of the present invention is limited solely by the claims set forth below.

While certain features and embodiments of the present invention have been described herein, it will be readily understood that the invention encompasses all modifications and enhancements within the scope and spirit of the claims herein stated.

We claim:

1. A concealable key, comprising:

a) a generally flat circular body including a flat support ring comprising first and second arcuate ring portions;

b) a key portion having a gripping portion and connected between said ring portions by a first flexible hinge connected between said gripping portion and said first ring portion, and a second flexible hinge connected between said gripping portion and said second ring portion, said key portion having a barrel connected to said gripping portion;

c) said key, including said support ring portions, hinges and key portion, being made of a single integrally molded piece of plastic material; and d) said support ring portions defining, therebetween, an open space, said gripping portion and hinges being contained within said open space.

2. The key of claim 1, wherein said ring portions have flat co-planar top surfaces and flat co-planar bottom surfaces, said open space extending between said ring portions and having a thickness defined by planar extensions of said top and bottom surfaces.

3. The key of claim 1, said barrel including a blind bore.

4. The key of claim 3, said key portion including a locking pin extending opposite to said barrel.

5. The key of claim 1, said key portion including a locking pin.

6. The key of claim 1, wherein said gripping portion includes two opposed concave surfaces.

7. The key of claim 1, wherein said plastic material comprises either one of glass fiber reinforced NYLON or polyester.

8. The key of claim 1, said support ring having a flat surface adapted to receive an adhesive.

9. The key of claim 8, said adhesive comprising a piece of tape.

* * * * *